US006036146A

United States Patent [19]

Paterson

[11] Patent Number: 6,036,146

[45] Date of Patent: Mar. 14, 2000

[54] SAFETY CABLE SYSTEM

[75] Inventor: Bruce W. Paterson, Chardon, Ohio

[73] Assignee: Kilroy Structural Steel Co., Cleveland, Ohio

[21] Appl. No.: 09/054,627

[22] Filed: Apr. 3, 1998

[51] Int. Cl.[7] ..... A47F 5/00; A47L 3/02

[52] U.S. Cl. ..... 248/125.2; 182/113

[58] Field of Search ..... 182/113; 256/59, 256/DIG. 6; 248/125.2

[56] References Cited

U.S. PATENT DOCUMENTS

| | | | |
|---|---|---|---|
| 2,706,662 | 4/1955 | Brown | 182/113 |
| 3,880,405 | 4/1975 | Brueske | 256/59 |
| 3,937,415 | 2/1976 | Prinz | 242/396.1 |
| 4,037,824 | 7/1977 | Whitmer | 256/53 |
| 5,029,670 | 7/1991 | Whitmer | 182/113 |
| 5,307,897 | 5/1994 | Turner et al. | 182/3 |
| 5,358,068 | 10/1994 | Whitmer | 182/113 |
| 5,464,070 | 11/1995 | Griek et al. | 182/45 |

*Primary Examiner*—Derek J. Berger
*Assistant Examiner*—David Heisey
*Attorney, Agent, or Firm*—Rankin, Hill, Porter & Clark LLP

[57] ABSTRACT

A safety cable system to which the lanyard of a worker's safety harness may be slidably connected while erecting a steel framework. The system includes a number of stanchion assemblies adapted to be mounted on a structural I-beam before the beam is lifted into position. These include a main stanchion, at least one intermediate stanchion and an end stanchion. The main stanchion has a cable supply reel that may be locked in a secured position to maintain desired tension once the end of the cable is connected to an end stanchion. The cable reel can be released to permit extension of the cable along a new beam to another end stanchion.

7 Claims, 6 Drawing Sheets

SAFETY CABLE SYSTEM

BACKGROUND OF THE INVENTION

This invention relates to a safety cable system such as for use in erecting a steel framework during the construction of bridges and buildings where work must be performed at great heights with unusual risk. More particularly, the invention relates to a safety cable system adapted to be mounted on steel I-beams prior to their being lifted into place, the system providing a life line to which a lanyard from a workers' safety harness can be attached, as well as a hand hold along the side of a beam once it is installed.

The risks presented to workers in the steel erection process can be considerable and the protection of these workers from fall during the assembly of the steel framework is extremely important. Accordingly, the protection of workers during the steel erection process has become the subject of increasing governmental regulation.

Many fall protection systems currently in use provide for tying off the worker to a cable that may be anchored and supported in a variety of ways. However, there are often few or no suitable anchoring points except at the feet of the worker. This increases the danger of tripping and increases fall distance. If there are vertical tie off points, a cable can be strung and the worker typically wears a harness or belt with a lanyard that connects to the cable. However, the cable is ordinarily located in the plane of the workers walkway and thus is a hindrance.

Certain improved systems utilize safety line cables supported on the top of stanchions with a pass-through-type connector for the worker's lanyard. This permits the lanyard to maintain continuous connection to the safety line cable while being slid along the cable past the stanchions without the need to disconnect the lanyard from the cable.

In the event of an accidental fall, the worker will have his or her fall arrested by the lanyard fastened to the safety line cable and to the workers body harness. This provides a safety arrangement that is relatively easy to install and which permits greater freedom of movement of the worker.

Nevertheless, conventional fall protection systems frequently do not provide a satisfactory level of protection, are not easily installed and commonly interfere with the construction process.

The safety cable system of the present invention, however, reduces the difficulties outlined above and affords other features and advantages heretofore not obtainable.

SUMMARY OF THE INVENTION

It is among the objects of the present invention to provide a safety cable system that includes a safety line to which a lanyard from a worker's safety harness can be attached, and which also provides a hand hold, offset from the center line of the particular horizontal beam on which the worker is located.

Another object of the invention is to provide a safety cable system that utilizes a number of posts or stanchions that are clamped to the flange of an I-beam, and which permit the lanyard extending from a workers safety harness to be easily slid past the post or stanchion without a need to disconnect the lanyard from the safety cable.

Still another object is to provide a safety cable system whereby the length of the cable, supported by the posts or stanchions, can be extended while the system is still in place, along an additional beam that is aligned with the beam on which the system is initially mounted.

These and other objects and advantages are achieved with the unique fall protection system of the invention which provides for the personal safety of workers on a construction site by means of a safety cable supported by posts or stanchions with each of the terminal ends of the cable suitably secured.

The safety cable is supported at the top of stanchions in such a way as to permit the lanyard of a worker to maintain a continuous connection to the cable while being slid along the cable past an intermediate stanchion without being disconnected from the cable. Should a fall occur, the worker will have his fall arrested by the lanyard fastened to the safety cable and to the workers safety harness.

The system includes a number of removable stanchion assemblies adapted to be mounted on a structural I-beam before the beam is lifted into position for installation in a steel framework. These assemblies include a main stanchion, at least one intermediate stanchion and an end stanchion. The main stanchion has a cable supply reel supported thereon with a length of cable wrapped on the reel, but being unwound sufficiently to extend along the side of the beam to the end stanchion. The reel is locked in a secured position to maintain desired tension once it is connected to the end stanchion.

As construction progresses, the cable reel can be released so as to permit the extension of the cable along an aligned beam to another end stanchion. Once an additional extension of the cable occurs, the reel is locked in position to the main stanchion so as to secure and tension the cable.

The intermediate stanchion is so constructed that a worker can easily move from one side of the stanchion to the other and move his safety lanyard past the stanchion without having to disconnect the safety lanyard or to remove the safety cable from the point where it connects to the intermediate stanchion.

DESCRIPTION OF THE PREFERRED EMBODIMENT

Figure 1:
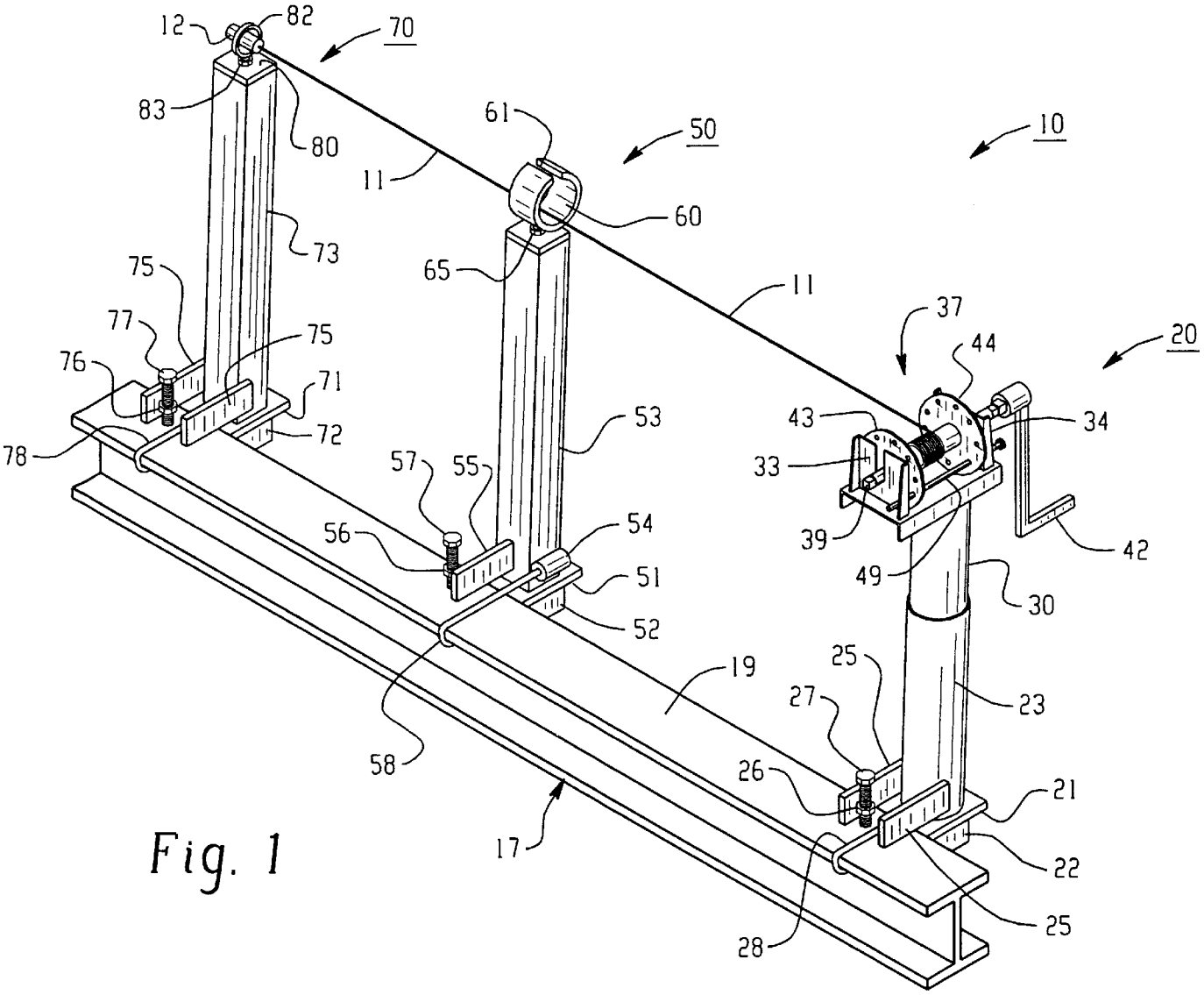
FIG. 1 is an metric view showing a steel I-beam with a safety cable assembly embodying the invention, installed thereon prior to the lifting of the beam into position.
Figure 8:
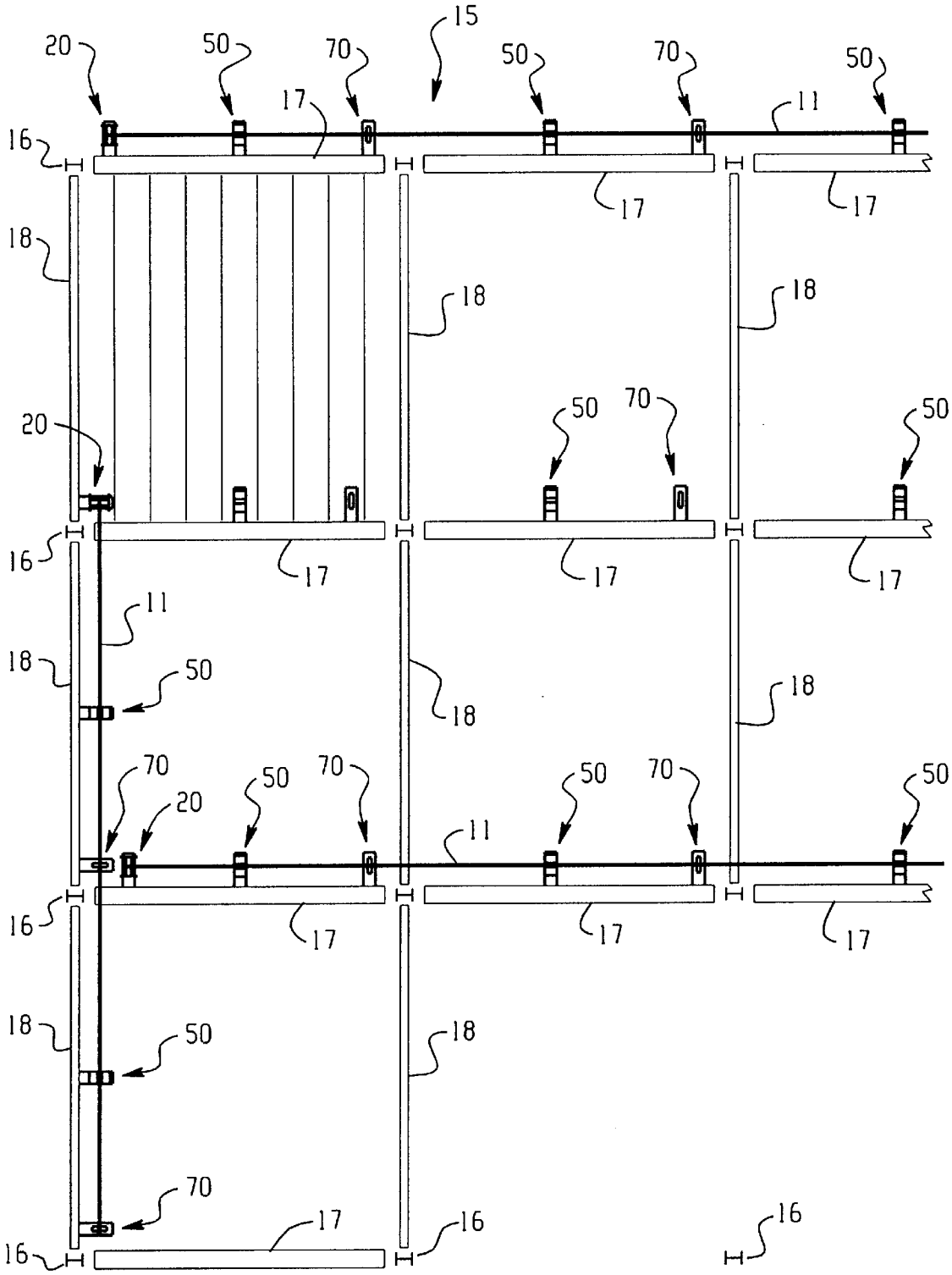
FIG. 8 is a plan view illustrating the use of the safety cable system embodying the invention in a particular steel framework which is in the process of being assembled.

Referring more particularly to the drawings and initially to FIG. 1, there is shown a safety cable assembly 10 including a safety cable 11. The assembly includes a main stanchion assembly 20, an intermediate stanchion assembly 50 and an end stanchion assembly 70. The safety cable 11 is connected to the tops of all three stanchion assemblies 20, 50 and 70 and has a snap hook 12 on one end that is attached to the end stanchion assembly 70. The cable provides a safety line to which the lanyard from a worker's safety harness, can be attached. The safety cable assembly is adapted to be used in the erection of a steel framework 15 (FIG. 8) comprising vertical columns 16, main horizontal beams 17 and joist girders or bar joists 18.

In FIG. 1, a safety cable assembly 10 is shown mounted on a beam 17, The assembly is normally mounted on the beam before it is lifted into position for installation in the superstructure. Once the beam is in place, subsequent beams that are aligned end-to-end with the beam 17 may merely have intermediate stanchion assemblies and an end stanchion assembly mounted thereon. A cable reel mounted on the main stanchion assembly provides a supply of cable so that the initial length of cable can be extended progressively as needed.

Figure 2:
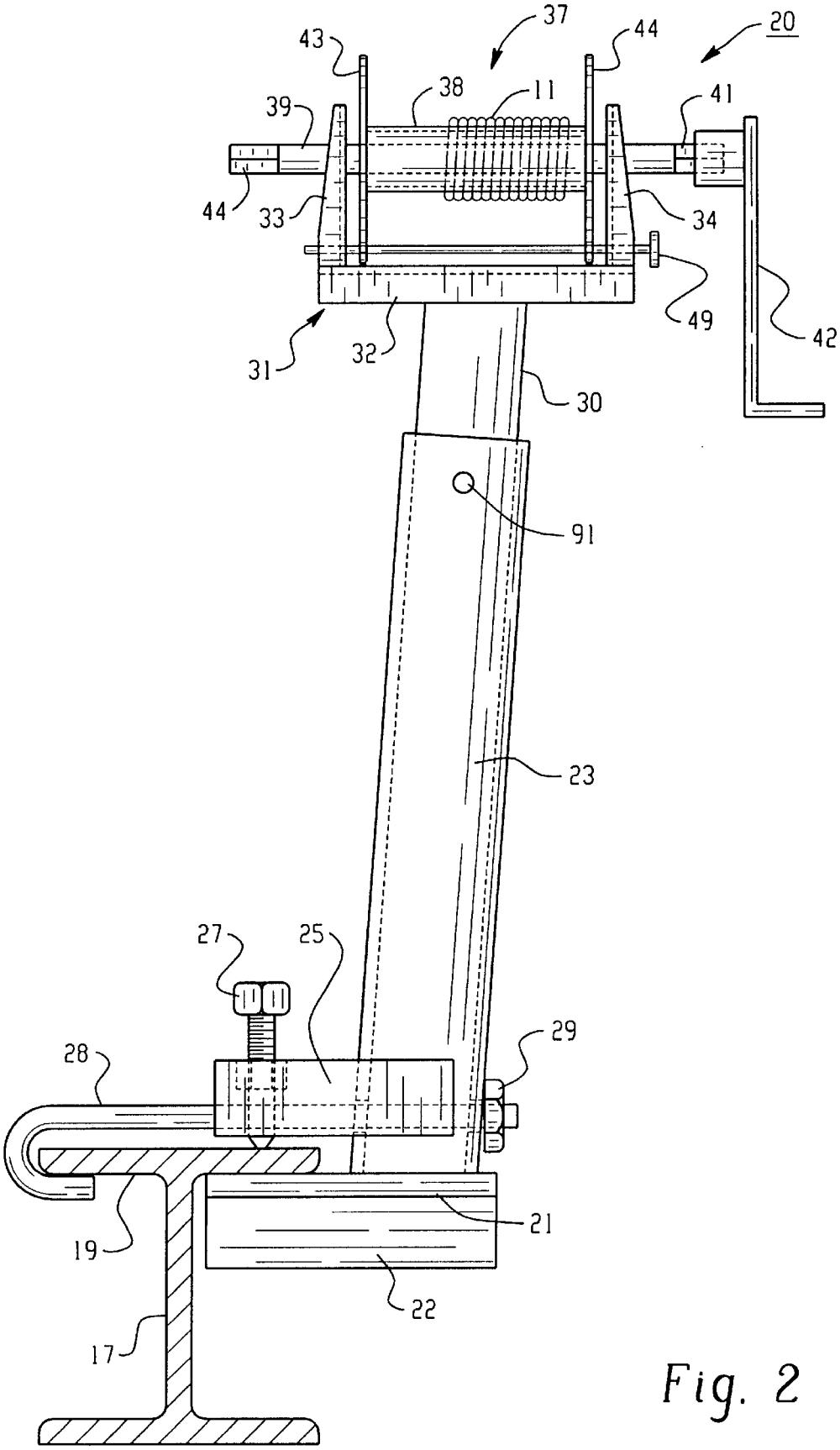
FIG. 2 is an elevation view showing a main stanchion mounted to the top flange of an I-beam at one end thereof.
Figure 3:
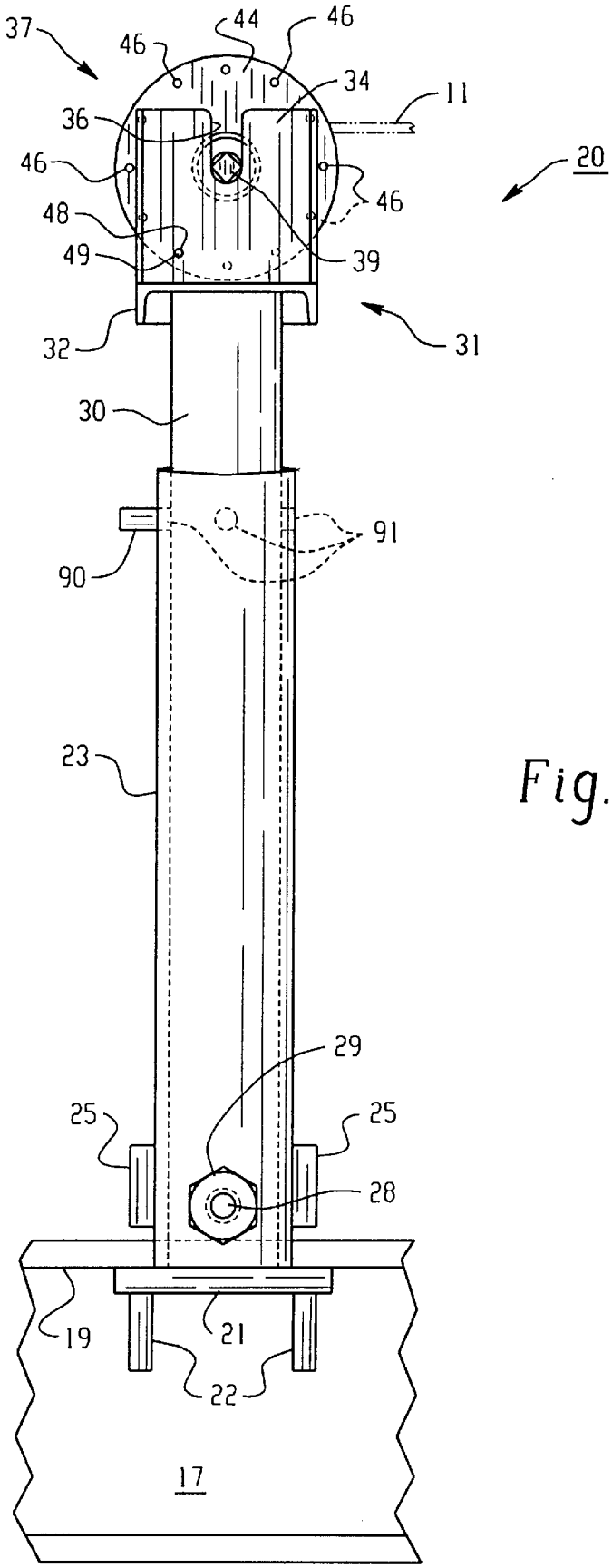
FIG. 3 is an elevational view showing the main stanchion illustrated in FIG. 2.

The main stanchion assembly 20 (FIGS. 2 and 3) includes a base plate 21 with a pair of stiffeners 22 welded to the bottom thereof. The base plate 21 supports a lower cylindrical tube 23 which has a pair of holes 24 extending through the lower end thereof along an axis perpendicular to the beam 17. The tube 23 tilts outwardly from the beam 17. A pair of parallel brackets 25 are welded to opposite sides of the cylindrical tube 23 and also extend perpendicular to the steel beam 17. The brackets have a nut 26 welded thereto offset from the axis of the holes 24. A clamping bolt 27 is threaded through the nut and is tightened down against the top flange 19 of the I-beam once the base plate 21 is slid under the bottom face of the top flange.

A clamp rod 28 extends through the holes 24 and is secured in place using a nut 29. The clamp rod has a hooked outer end that is adapted to hook around the edge of the top flange 19 of the steel I-beam 17. By tightening the nut 29, the connection of the main stanchion assembly 20 to the I-beam is completed.

The assembly also includes an upper cylindrical tube 30 with a sleeve portion that is received within the top portion of the lower cylindrical tube 23. Welded to the top of the tube 30 is a reel fork 31 that includes a base 32, a pair of upwardly extending arms 33 and 34, each having a vertical slot 35, 36 formed therein. A reel 37 having a reel hub 38, is installed in the slots and has a reel shaft 39 supported by the arms 33 and 34. The shaft 39 has squared ends 40 and 41 that permit a hand crank 42 to be connected thereto for turning the reel.

The reel also includes a pair of flanges 43 and 44 each of which has a plurality of circumferentially spaced holes 45 and 46. Likewise, the fork arms 33 and 34 each have aligned holes 47, 48 formed therein that are adapted to register with the flange holes 45 and 46. A lock pin 49 is inserted through the pair of holes 45 and 46 and through the holes 47 and 48 so as to lock the reel 37 in place on the fork. Accordingly, when the safety cable 11 is extended from the reel and connected to the end stanchion assembly 70, the cable may be tightened using the crank 42 and then secured in a taught position by use of the lock pin 49.

Figure 4:
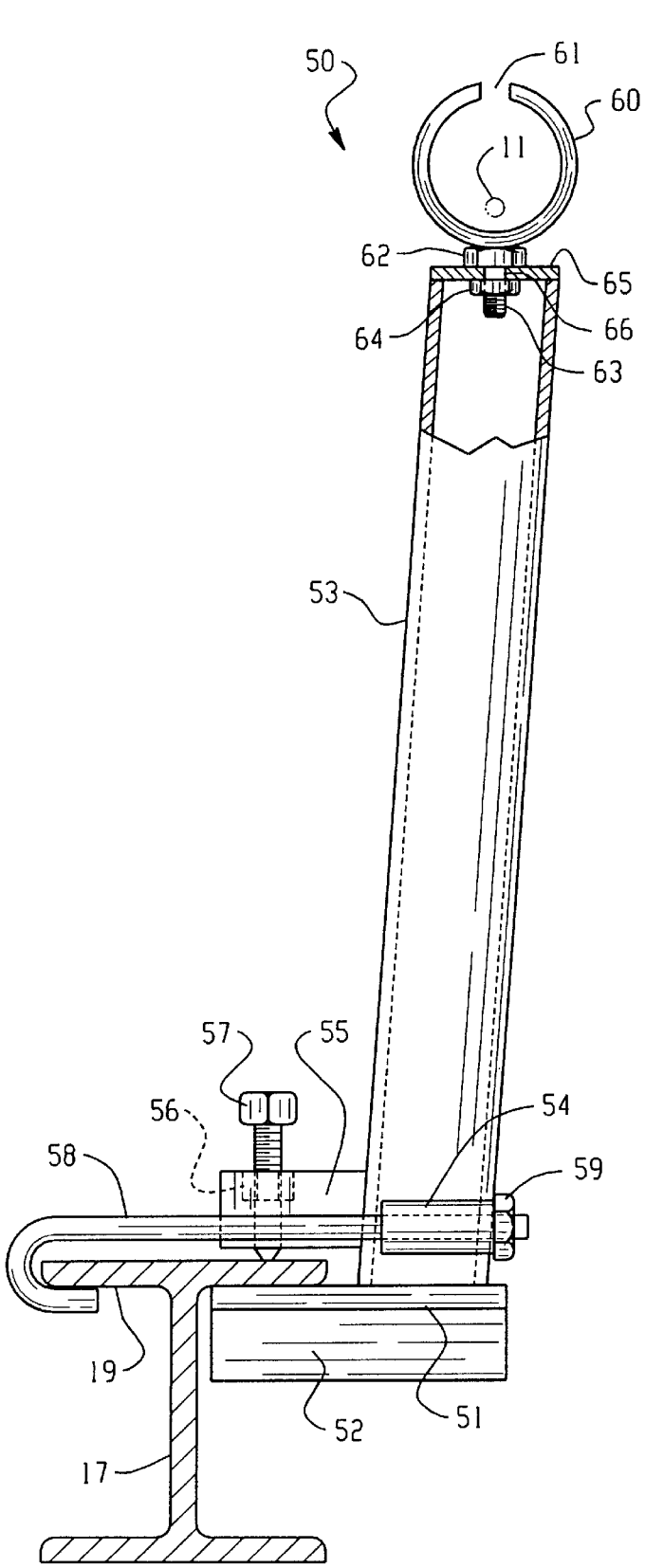
FIG. 4 is an end elevational view of an intermediate stanchion of a safety cable system embodying the invention with parts broken away for the purpose of illustration.
Figure 5:
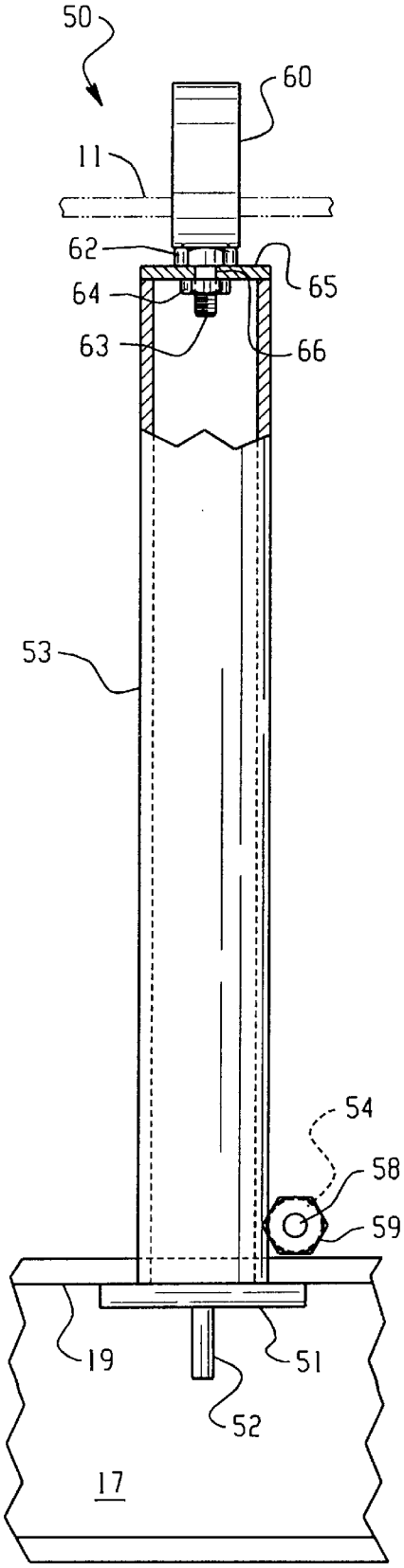
FIG. 5 is a side elevation view of the intermediate stanchion of FIG. 4 with parts broken away for the purpose of illustration.

The intermediate stanchion assembly 50 (FIGS. 4 and 5) includes a base plate 51 with a single stiffener 52 mounted to the bottom thereof. A rectangular tube 53 is welded to the top of the base plate. A cylindrical steel sleeve 54 is welded to the side of the tube 53 near the bottom as best shown in FIGS. 1 and 4. A bracket 55 is welded to the center of the rectangular tube 53 (FIG. 4) and has a nut 56 supported thereby and welded thereto. A clamping bolt 57 is threaded into the nut 56 and is adapted to tighten down against the top flange 19 of the steel I-beam 17 once the base plate 51 is slid under the bottom face of the top flange.

A clamp rod 58 extends through the sleeve 54 and is secured in place by a nut 59. The clamp rod has a hooked outer end that is adapted to hook around the edge of the top flange 19 of the I-beam 17. By tightening the nut 59, the connection of the intermediate stanchion assembly 50 to the I-beam is completed.

A top plate 65 is welded to the top of the rectangular tube 53 and has a central opening 66 extending there through. Located above the top plate 65 is a guide ring 60 adapted to receive and retain the cable 11. The guide ring may be cut, for example, from a length of 5 in. steel tube. An opening or slot 61 is cut at the top of the ring 60 to permit a workman's lanyard to pass through the slot so as to enable a worker to move past the intermediate stanchion assembly without any need to disconnect the lanyard from the cable 11. The bottom of the guide ring 60 is welded to the head 62 of a bolt 63 that extends through the opening 66 into the interior of the tube 53. A nut 64 is threaded on to the lower end of the bolt 63 and tack welded thereto, to permit the guide ring to swivel on top of the stanchion.

Figure 6:
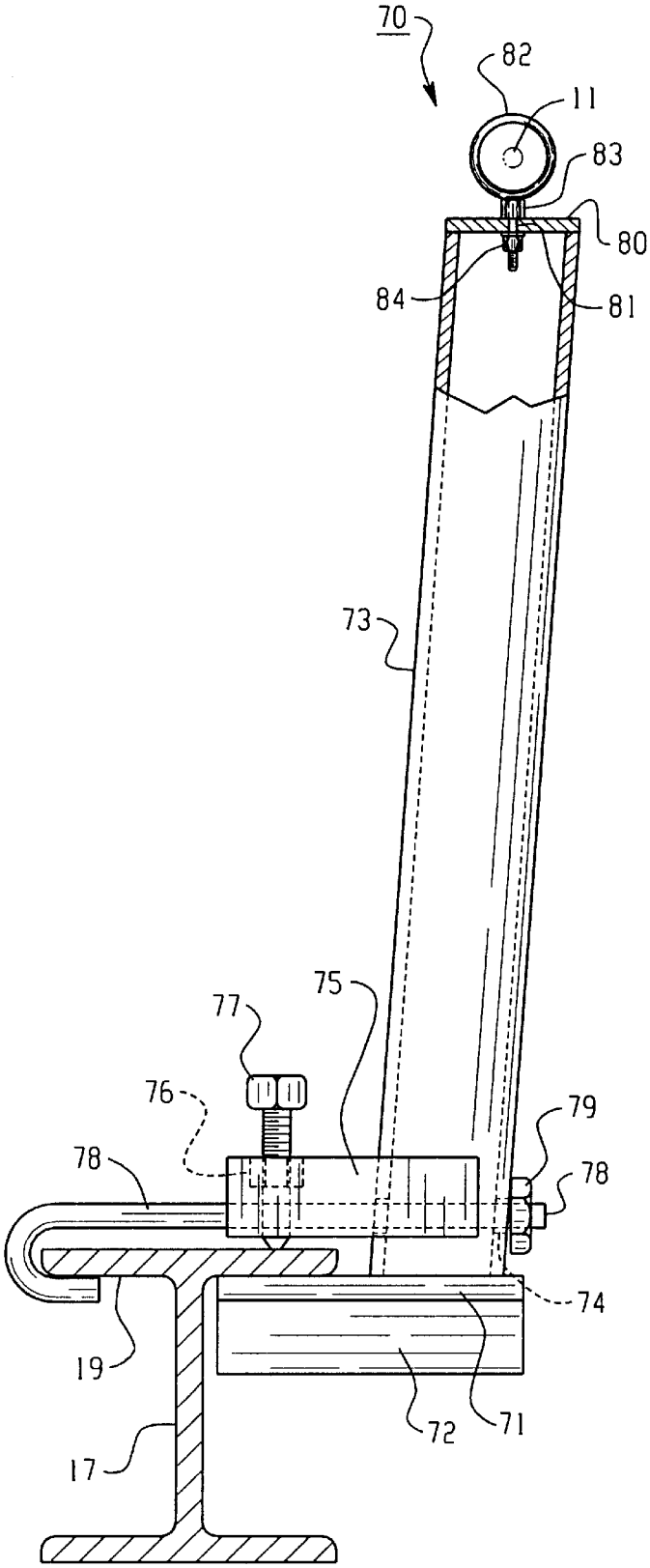
FIG. 6 is an elevational view showing an end stanchion mounted of a safety cable system embodying invention with parts broken away for the purpose of illustration.
Figure 7:
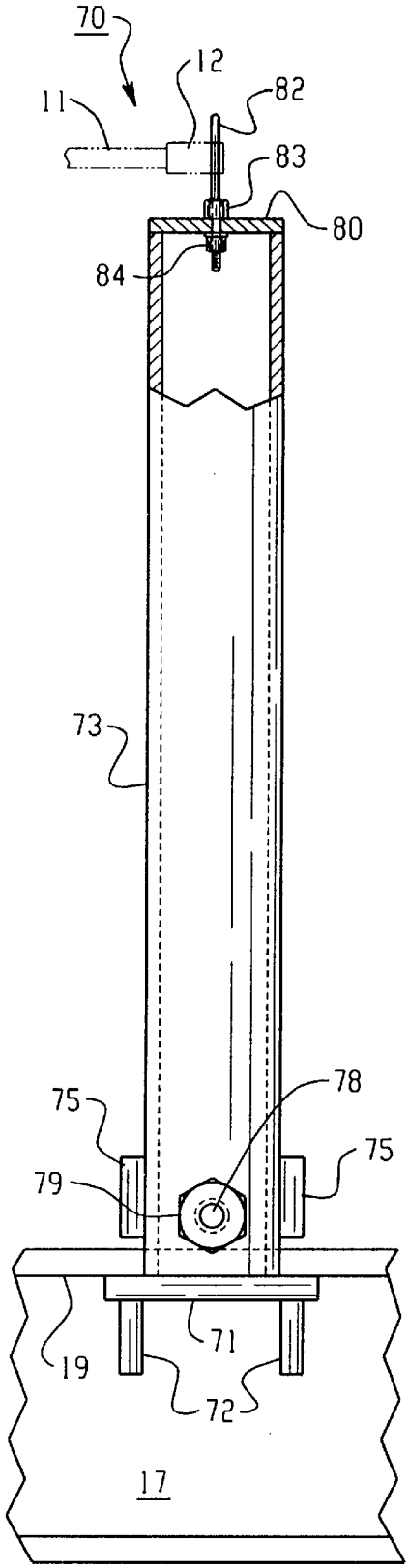
FIG. 7 is a side elevation view of the end stanchion of FIG. 6 with parts broken away for the purpose of illustration.

The end stanchion assembly 70 (FIGS. 6 and 7) includes a base plate 71 with a pair of stiffeners 72 welded to its bottom surface. A rectangular tube 73 is welded to the top of the base plate 71 and has a pair of aligned holes 74 extending therethrough along an axis that is perpendicular to the I-beam 17. A pair of parallel brackets 75 are welded to opposite sides of the rectangular tube 73 and are adapted to support a nut 76 which is welded to the brackets but at a location that is offset from the axis of the holes 74. The nut 76 is adapted to receive a clamping bolt 77 that is threaded therethrough and is tightened down against the top flange 19 of the steel I-beam once the base plate 71 is slid under the bottom face of the I-beam 17.

A clamp rod 78 extends through the holes 74 and has a hooked outer end that is adapted to hook around the edge of the top flange of the I-beam 17. The clamp rod 78 is tightened into position using a nut 79 that is threaded onto the end that extends outwardly from the rectangular tube 73.

The upper end of the rectangular tube has a top plate 80 welded thereon with a central opening 81. An eye bolt 82 with a nut 83 at the upper end of its shank is secured to the top plate 80 by extending it through the opening 81 and tack welding the lower end to a nut 84 which is threaded thereon. This arrangement permits the eye bolt to be swivelled to any position desired. The end of the cable 11 has a snap hook 12 secured thereto which in turn is attached to the eye bolt 82 of the end stanchion 70.

The safety cable assembly 10 is initially installed on a steel I-beam (FIG. 1) before the beam is lifted into position in the steel framework. The three stanchion assemblies 20, 50 and 70 are clamped to the beam 17 at desired locations and the cable reel 37 is unwound so that the cable 11 may be extended along the length of the beam to the end stanchion 70 where a snap hook 12 on the end of the cable is hooked to the eye bolt 82. When this is done the reel 37 is turned in a direction tending to tension the cable using the hand crank 42. Then the lock pin 49 is inserted through the holes 45 and 46 in the arms 33 and 34 and also through a pair of corresponding holes 43 and 44 in the reel flanges 43 and 44. This locks the reel to prevent unwinding and also tensions the cable.

It will be noted that the safety cable 11 is placed in the ring 60 by passing it through the notch 61.

When this installation is complete the beam 17 is lifted into place in the framework 15.

Once in place a worker may connect his lanyard to the safety cable 11 and also may use the cable as hand hold while walking along the beam.

It will be noted that the safety cable assembly 10 is illustrated in connection with a main beam 17 that forms part of a framework (FIG. 8) that comprises a number of main beams 17 placed end-to-end and supported on vertical columns 16, the beams 17 all being parallel to one another. Then a number of joist girders or bar joists 18 are located perpendicular to the main beams 17 and secured thereto.

It will be noted that as additional beams are aligned end-to-end with a beam that is already installed, the next aligned beam may be provided with intermediate stanchion assemblies 50 and an end stanchion assembly 70 so that the end of the safety cable 11 may be released from the particular eye bolt 82 to which it is initially connected. Before this is done the lock pin 49 that locks the reel 37 is removed to release the reel and then the safety cable may be extended along the length of the newly installed I-beam up to another end stanchion assembly 70 located at the outer end of the cable. This process may be repeated as necessary so that the entire length of aligned main beams in a framework can be provided with a safety cable.

As another aspect of the invention, a length of cable may be rewound on the reel 37 once it is no longer necessary and the pin 90 that locks the upper cylindrical tube 30 to the lower cylindrical tube 23 of the main stanchion assembly 20 may be removed from the holes 24 in the lower tube and the upper portion of the main stanchion assembly rotated relative to the lower cylindrical tube 23 to a position 90° to its initial position. Then the lock pin 90 may be reinserted in a new pair of holes 91 in the upper cylindrical tube 30 to lock the upper reel portion in a new position relative to the beam 17.

Then the safety cable 11 may be extended along one or more joist girders 18 located perpendicular to the main beam 17 and connected to an end stanchion assembly 70 that has been mounted on one of the joist girders.

This arrangement permits the reel 37 and safety cable 11 to be re-rigged for use by workers securing the joist girders 18 to the framework.

It will be seen that the device of the present invention provides a safety cable system that is convenient and relatively easy to install, that provides a cable at a convenient location for worker to connect his lanyard to and still be able to move along the beam past intermediate stanchions with assurance that an accidental fall will be arrested by the system.

Furthermore, the assembly provides a means for extending the cable progressively during the assembly of the steel framework and also for rotating the reel 90° to accommodate the needs of workers installing crossbeams once the main beams are installed.

While the invention has been shown and described with respect to a specific embodiment thereof, this is intended for the purpose of illustration rather than limitation, and other variations and modifications of the specific safety cable assembly shown and described will be apparent to those skilled in the art all within the intended spirit and scope of the invention. Accordingly, the patent is not to be limited in scope and effect to the specific device herein shown and described, nor in any other way that is inconsistent with the extent to which the progress in the art has been advanced by the invention.

What is claimed is:

1. A safety cable system for use in erecting the steel framework during the construction of bridges and buildings so that the lanyard of a worker's safety harness may be slidably connected thereto comprising:

a plurality of removable stanchion assemblies adapted to be mounted on a structural beam prior to its installation in a building frame, said assemblies including:

a main stanchion having a fork member thereon with a pair of upstanding fork arms, each fork arm having an opening therethrough to form a pair of axially aligned fork arm openings axially spaced from one another along an axis perpendicular to said structural beam, at least one intermediate stanchion; and an end stanchion;

a cable supply reel journaled on said main stanchion for rotation about a reel axis and having a pair of axially spaced circular flanges, a length of cable on said reel;

said reel being adapted to wind said cable thereon to retract said cable or to unreel said cable therefrom whereby said cable may be extended and slidably connected to an intermediate stanchion and fixedly connected to said end stanchion; and means for selectively locking said reel flanges to said main stanchion when said cable is extended to and connected to said end stanchion, said locking means comprising a plurality of circumferentially spaced openings in each flange to form pairs of aligned flange openings axially spaced from one another and in opposite flanges, said pairs of flange openings adapted to be selectively aligned with said fork arm openings, and a lock pin adapted to be moved axially through said fork arm openings and through a pair of said flange openings to a locking position to lock said reel against rotation in either direction relative to said main stanchion.

2. A safety cable system as defined in claim 1 wherein said main stanchion comprises a lower cylindrical tube connected at its lower end to said beam and an upper cylindrical tube that supports said cable supply reel, said upper cylindrical tube having a lower portion adapted to be rotatably received in the upper portion of said lower cylindrical tube, and means for locking said upper cylindrical tube to said lower cylindrical tube.

3. A safety cable system as defined in claim 2 wherein said means for locking said upper cylindrical tube to said lower cylindrical tube comprises at least one radial opening formed in the upper end of said lower cylindrical tube, at least two radial openings located at 90° to one another formed in the lower end of said upper cylindrical tube and a removable lock pin adapted to extend through said radial opening in said lower cylindrical tube and through one of said radial opening in said upper cylindrical tube to secure said upper cylindrical tube selectively in one of two positions relative to said lower cylindrical tube.

4. A safety cable system as defined in claim 1 wherein said intermediate stanchion has a guide ring mounted at the top thereof and adapted to receive and retain said length of cable when extended there through said guide ring having an opening cut therein at the top thereof to permit said lanyard of a worker to be passed through said opening while connected to said length of cable so that the worker may move along the beam past the intermediate stanchion without disconnecting the lanyard from the length of cable.

5. A safety cable system as defined in claim 4 wherein said guide ring is mounted on said intermediate stanchion to swivel about the generally vertical axis.

6. A safety cable system as defined in claim 1 wherein said end stanchion has an eye bolt secured to the top thereof whereby the end of said length of cable may be connected to said eye bolt.

7. A safety cable system as defined in claim 6 wherein said eye bolt is mounted on said end stanchion to swivel about the generally vertical axis.

* * * * *